United States Patent [19]

Contant

[11] Patent Number: 4,953,818

[45] Date of Patent: Sep. 4, 1990

[54] HOLDER FOR BEVERAGE BOXES

[76] Inventor: Bernard Contant, 731 Boul., Desaulniers, St.-Lambert, Qc, Canada, J4P 1P7

[21] Appl. No.: 221,214

[22] Filed: Jul. 19, 1988

[30] Foreign Application Priority Data

Jul. 20, 1987 [GB] United Kingdom ..... 8717127

[51] Int. Cl.[5] ..... B67D 5/06

[52] U.S. Cl. ..... 248/222.3; 222/181

[58] Field of Search ..... 248/200, 214, 220.2, 248/222.2, 222.3, 223.4, 224.1, 224.2, 309.1, 311.2, 323, 312.1, 313, 317, 342, 500, 506; 24/590, 591, 594, 663; 206/806; 222/181

[56] References Cited

U.S. PATENT DOCUMENTS

| | | | |
|---|---|---|---|
| 1,160,458 | 11/1915 | Smith | 24/594 |
| 2,016,041 | 10/1935 | Koopetz | 24/590 |
| 2,546,635 | 3/1951 | Farkas . | |
| 2,632,618 | 3/1953 | Griglak . | |
| 3,180,606 | 4/1965 | Sabin | 24/590 |
| 3,627,177 | 12/1971 | Marcus | 222/181 |
| 3,666,226 | 5/1972 | Johansson | 248/214 |
| 3,743,147 | 7/1973 | Wilczynski | 24/590 |
| 3,998,360 | 12/1976 | Mack | 222/181 |
| 4,228,928 | 10/1980 | Hocker | 222/181 |
| 4,349,102 | 9/1982 | Strongwater | 206/806 |
| 4,373,632 | 2/1983 | Van Zandt | 206/806 |
| 4,527,760 | 7/1985 | Salacuse | 24/590 |
| 4,747,519 | 5/1988 | Green | 222/181 |

FOREIGN PATENT DOCUMENTS

| | | | |
|---|---|---|---|
| 61400 | 9/1912 | Switzerland | 24/590 |

*Primary Examiner*—Alvin C. Chin-Shue
*Assistant Examiner*—Robert A. Olson
*Attorney, Agent, or Firm*—Fay, Sharpe, Beall, Fagan, Minnich & McKee

[57] ABSTRACT

Holder for wine or other beverage boxes or the like which may be secured to a plane surface such as underneath a counter or directly to a wall by means of a support such as a L-shaped support. Said holder comprises a parallelepiped structure having an elongated element secured to same. In use, said elongated element is inserted into openings which are normally used as handles located on top of said boxes for engagement therein.

10 Claims, 9 Drawing Sheets

HOLDER FOR BEVERAGE BOXES

FIELD OF THE INVENTION

Holder for wine or other beverage boxes or the like which may be secured to a plane surface such as underneath a counter or directly to a wall by means of a support.

DESCRIPTION OF PRIOR ART

Traditionally, wine has been sold in wine bottles of varying sizes. When such glass bottles are opened, it is necessary to consume the wine promptly otherwise it will rapidly become oxidated.

In recent years, wine and other liquids such as milk and juices have been "bottled" in collapsible containers comprising a valve or other device allowing the desired quantity of beverage to be served without allowing the entry of air in the container. Such collapsible containers are often placed in rigid boxes to facilitate transportation. Very often, these boxes comprise an opening in the top surface in which fingers may be introduced and which may grasp the surface adjacent such opening as if it were a handle. These boxes also comprise a valve or spout allowing the desired quantity of beverage to be poured.

Conventionally, known boxes for the transportation of wine consist of a somewhat parallelepiped cardboard container in which is inserted a bag made of an aluminum/plastic laminate in which the wine is contained.

Such boxes, once carried from the store, are often positioned on top of tables and counters, thus taking up valuable storage space.

The only support for such boxes of which the applicant is aware is a support that is placed directly on the table. The user has to remove the bag from the box and to place same in said support. This way of doing is obviously not convenient since it involves different steps. In addition, the main drawback of this system is that the support takes approximately the same space on the table or counter as the wine box.

OBJECTS OF THE PRESENT INVENTION

An object of the present invention is to provide a holder for wine or other beverage boxes having an opening in one of their surfaces which is easy to install either on a vertical surface such as a wall or underneath a horizontal surface such as shelves or the like, allowing the user to save storing space.

Another object of this invention is to provide a holder for such boxes, of the character described, designed to retain a wine box firmly in a readily accessible position so that the dispending means of the wine box can be easily employed.

Another object of the invention is to provide a holder for such boxes, having a novel and extremely simple structure, which is inexpensive to make and yet which is particularly strong.

A still further object of the invention is to provide a holder for such boxes which allows fast and easy securing of the box to the holder.

These and other objects of the present invention will be obtained by a holder for a wine or other beverage box or the like of the type provided with a recess or opening in one of its surfaces, comprising:

a first portion having securing means;

an elongated second portion comprising a first element and a second element secured to said first portion; wherein said first portion is secured to a surface such as underneath a shell or on a wall and said second portion is inserted into said recess of said box for engagement therewith.

BRIEF DESCRIPTION OF THE DRAWINGS

The invention will be more fully described in the following description of embodiments illustrated in the accompanying drawings.

DESCRIPTION OF A PREFERRED EMBODIMENT

Figure 1:
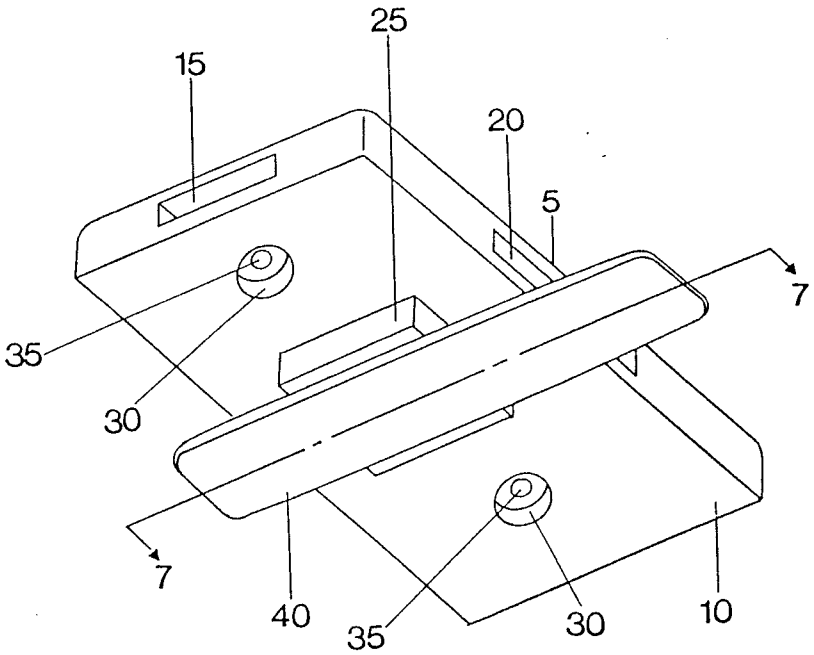
FIG. 1 is a perspective view of one embodiment of a wine box holder according to the invention.
Figure 2:
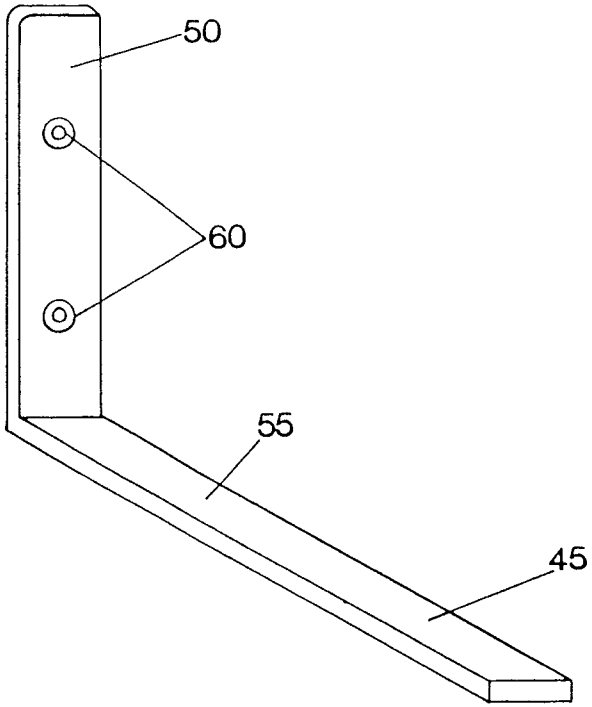
FIG. 2 is a perspective view of a support used in conjunction with the wine holder of FIG. 1.

Referring to the drawings and more particularly to FIG. 1, there is shown a holder 5 for a wine box 100 (in FIG. 3) having a parallelepipe shaped structure 10. Said structure has channels 15 and 20 which allow insertion of a longitudinally extending support. FIG. 2 shows one embodiment 45 of said support, which is generally L-shaped and is generally rectangular in cross section.

Figure 3:
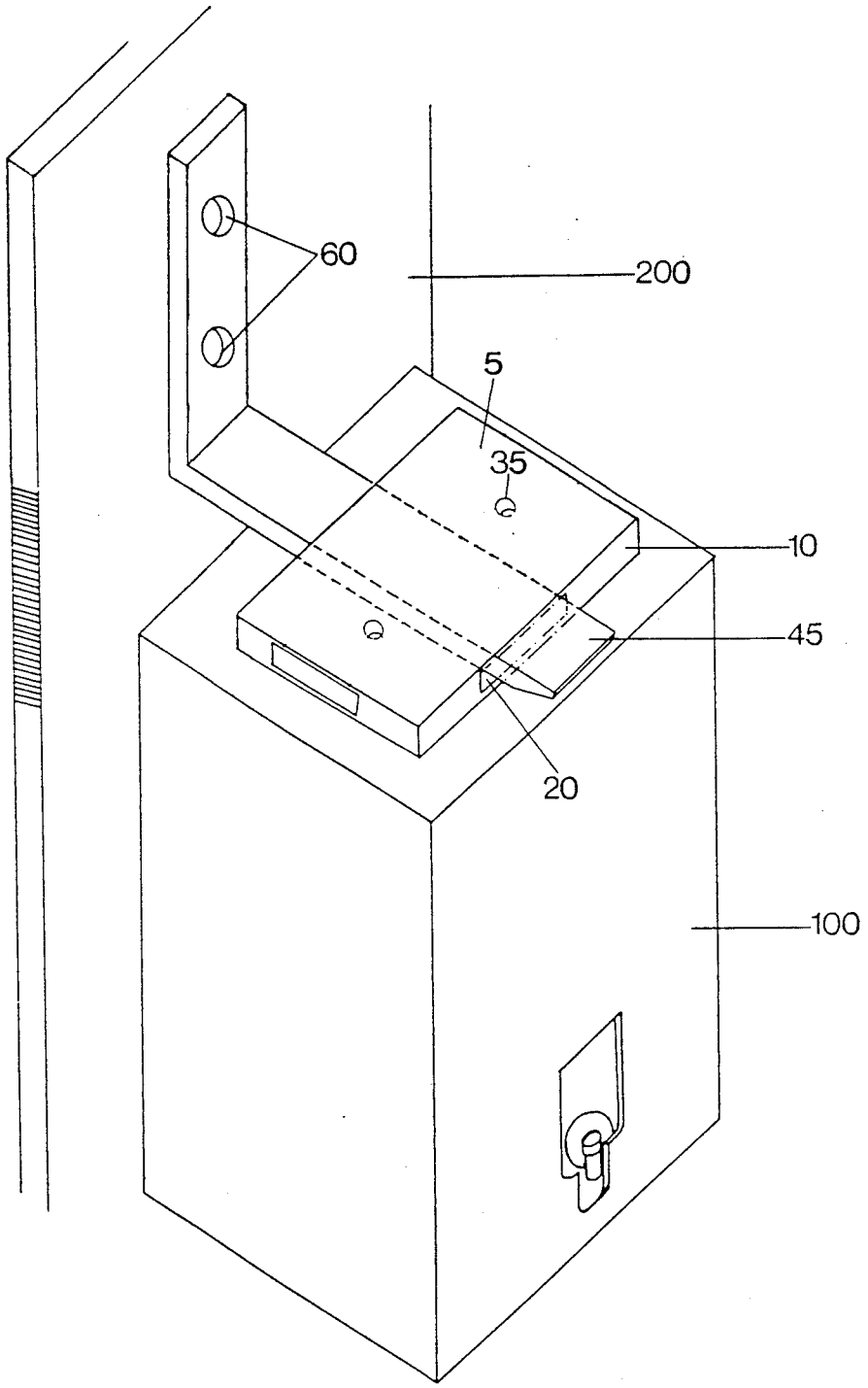
FIG. 3 is a perspective view of the holder and support shown in FIGS. 1 and 2 holding a box with the holder secured to a vertical structure.

With reference to FIG. 3, support 45 is used to secure the holder 5 to a vertical surface such as a wall 200.

As shown in FIG. 2, support 45 has a first portion 50 and a second portion 55. First portion 50 is used to secure the support to a substantially flat surface such as wall 200 whereas second portion 55 is adapted to slide inside either of channels 15 or 20 for engagement therein.

Figure 5:
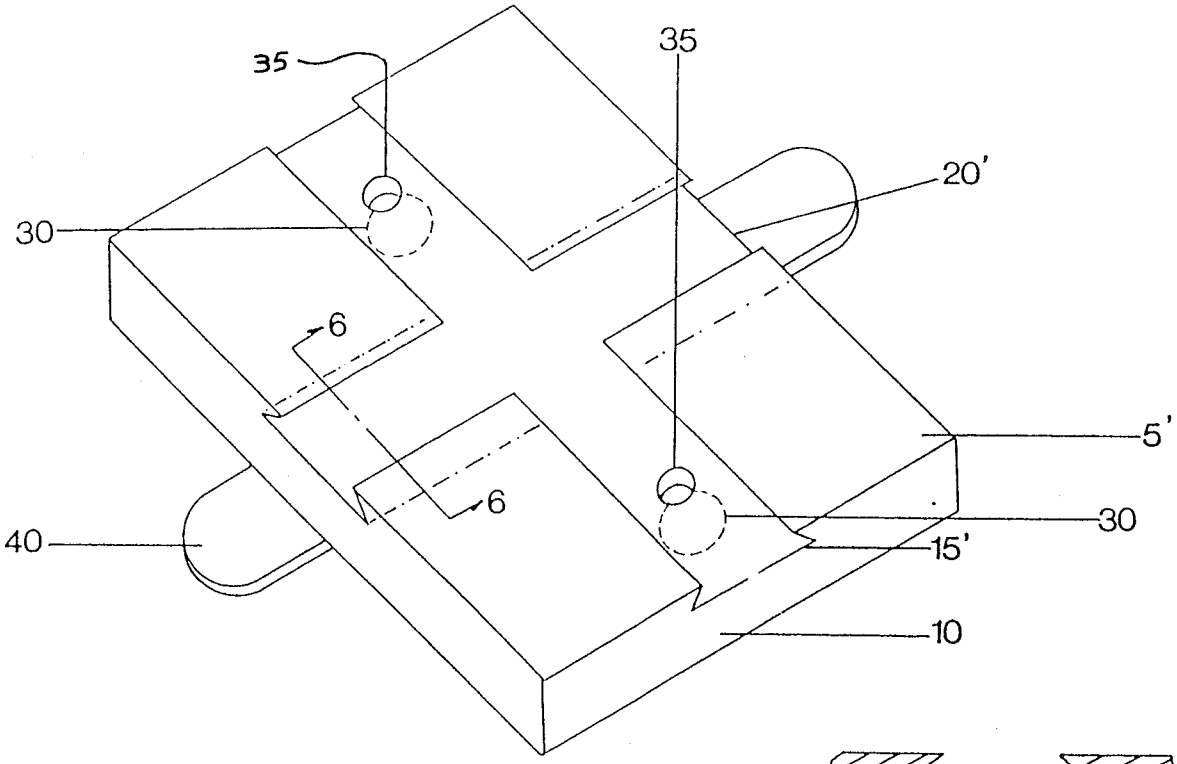
FIG. 5 is another embodiment of the holder of FIG. 1.

Variations 15' and 20' of channels 15 and 20 are illustrated in FIG. 5.

Figure 6:
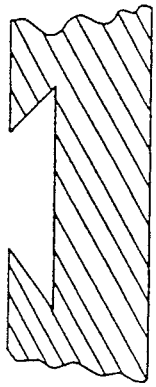
FIG. 6 is a section taken along line 6—6 of FIG. 5.
Figure 11:
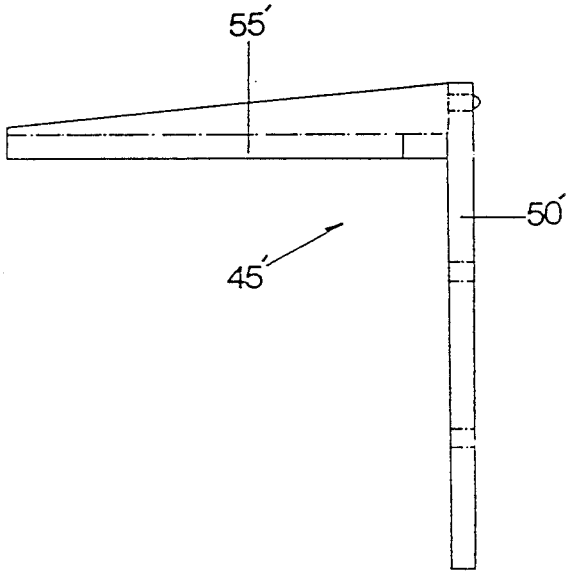
FIG. 11 is an elevation view of another embodiment of the support shown in FIG. 2.
Figure 12:
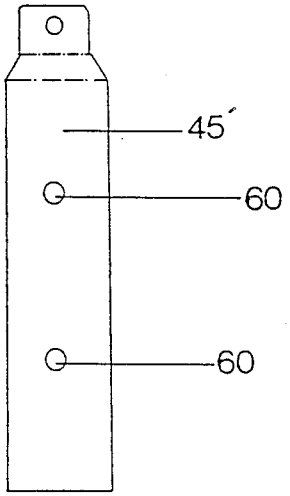
FIG. 12 is a side view of the support of FIG. 11.

Channels 15' and 20' have generally the shape of a trapezoid in a cross sectional view as more particularly shown in FIG. 6. FIGS. 11 and 12 show a variation 45' of support 45. The support 45' has a first portion 50' and a second portion 55'. The first portion is substantially the same as the first portion 50 of support 45 whereas the second portion 55' has been modified to allow proper engagement within either of channels 15' or 20'.

Supports 45 and 45' have holes 60 which allow insertion of fastening devices such as screws or the like.

Structure 10 also has holes 35 and recesses 30 which are used in conjunction with screws or the like as securing means.

Holes 35 allow insertion of screws or other fastening devices when the holder is secured underneath an horizontal surface. Recesses 30 provide a neater appearance.

The holder 5 also has an elongated wine box holding means. Said holding means has a double sided tongue 40 mounted on a base 25 which is itself secured to the structure 10.

The holder 5 should preferably be made of plastic, such as polypropylene. However, metal or any other suitable material may be used for the same purpose. When plastic is used, the double sided tongue 40, base 25 and the structure 10 may be molded in a single piece.

Figure 7:
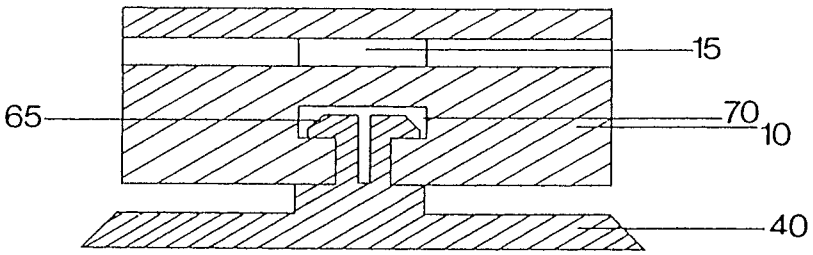
FIG. 7 is a cross section taken along line 7—7 of FIG. 1.
Figure 8:
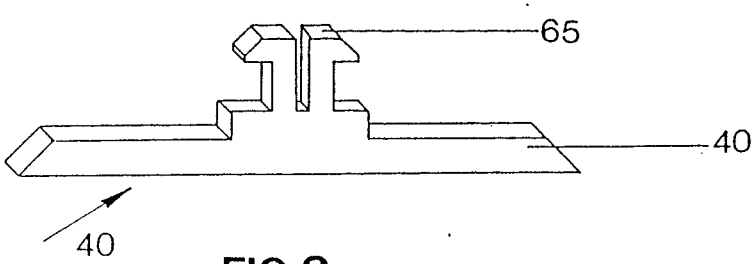
FIG. 8 is a perspective view of the double sided tongue shown in FIG. 7.
Figure 9:
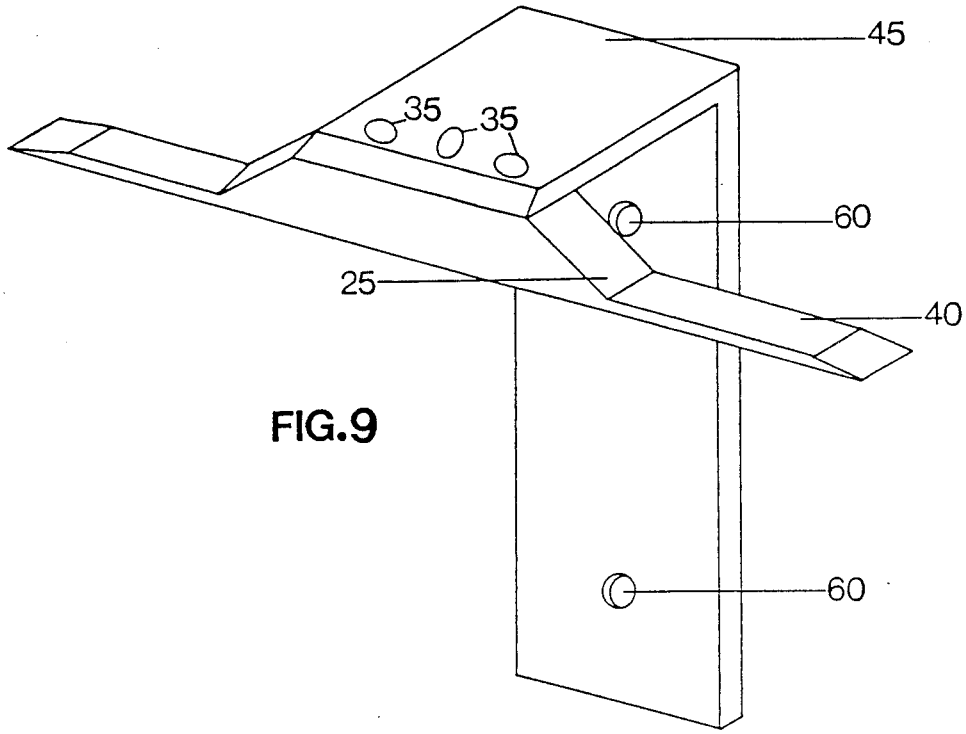
FIG. 9 is a perspective view of a still another embodiment of the holder of FIG. 1 and of the support of FIG. 2.

It is possible to manufacture the double sided tongue 40 and structure 10 separately and later assemble the individual elements together. Thus, the double sided tongue 40 may have a dovetail-shaped projection 65 as shown in FIGS. 7 and 8, whereas the structure 10 has a recess 70. The two elements are assembled simply by pressing the projection 65 into recess 70.

Figure 4:
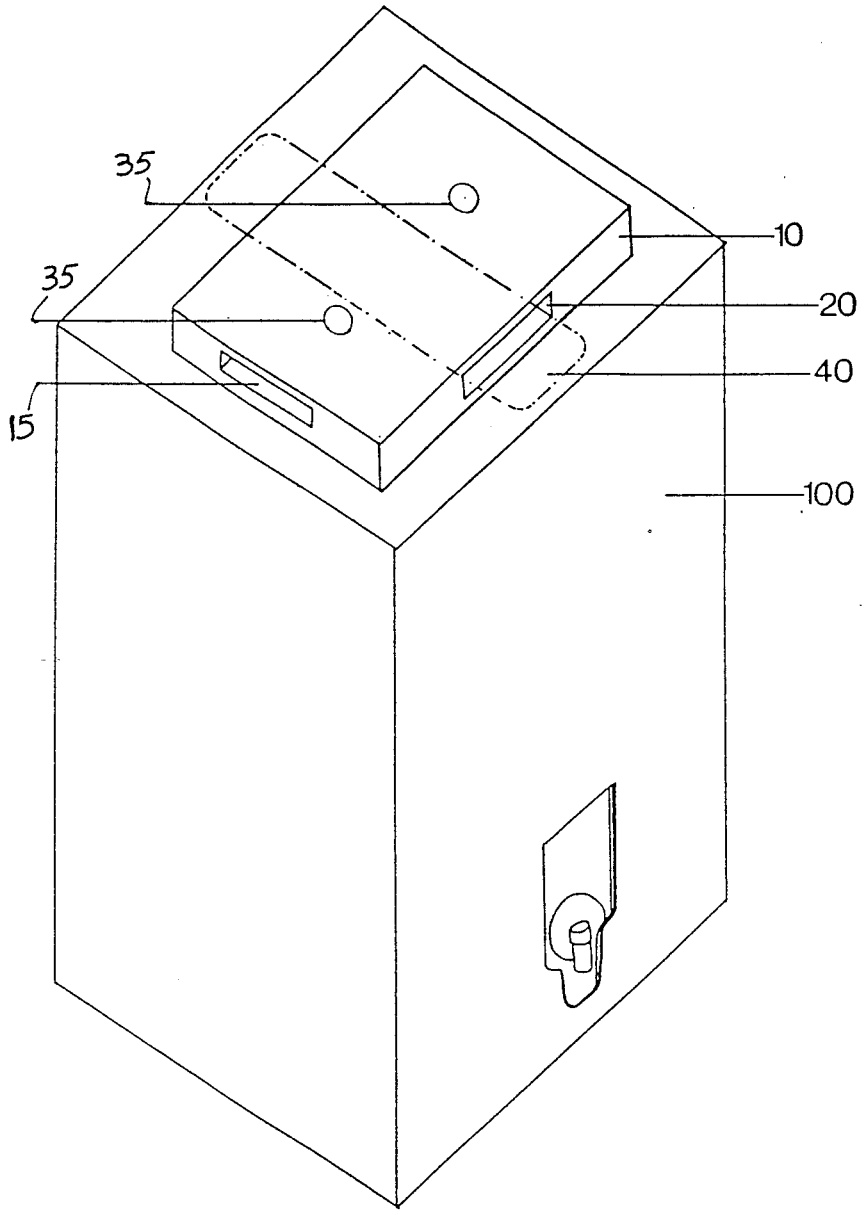
FIG. 4 is a perspective view of the holder shown in FIG. 1 without a support used to hold a box underneath an horizontal surface.
Figure 13:
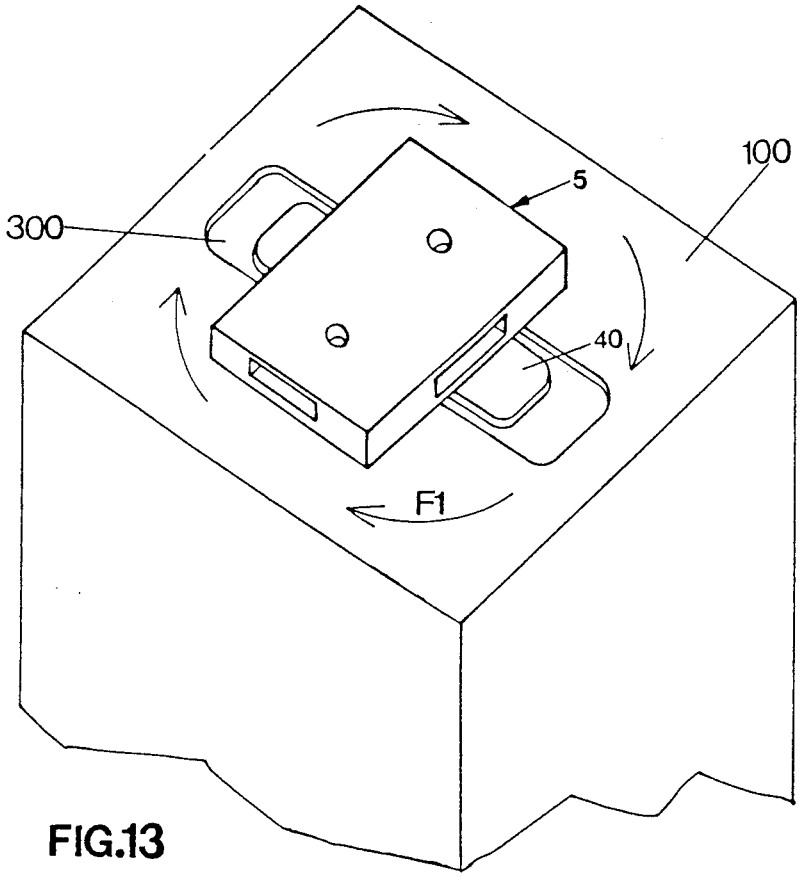
FIG. 13 is a perspective view showing the use of the holder shown in FIG. 1.

As shown in FIG. 13, to use the holder 5, the user has simply to insert the double sided tongue 40 into the hole 300 usually located in the top surface of the box 100. The double sided tongue 40 is inserted so that same is generally parallel to the hole 300. The holder is then rotated approximately 90° as shown by the arrow F1 in order that the double sided tongue 40 becomes perpendicular to hole 300. The box is then held in place on the holder as illustrated in FIGS. 3 and 4.

Figure 10:
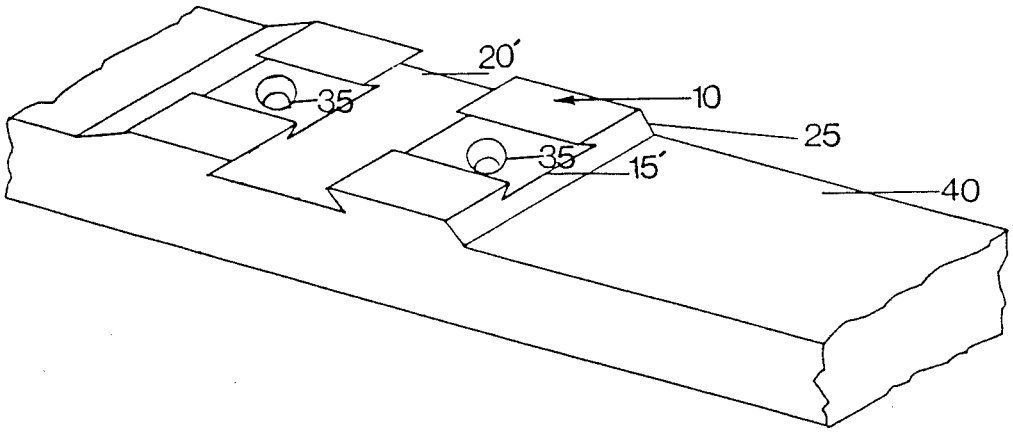
FIG. 10 is a perspective view of the holder shown in FIG. 9.

FIG. 10 shows another variation of the holder 5 of FIG. 1 wherein the structure 10 and the double sided tongue 40 are unitary. The upper portion of the structure 10 is provided with channels 15' and 20' as illustrated in FIG. 5.

The holder is not restricted to the embodiments described above and illustrated in the accompanying drawings. It can be modified in many ways within the scope of the attached claims. For example, the double sided tongue 40 could rotate with respect to the structure 10.

I claim:

1. A holder adapted to be mounted to a fixed supporting surface for holding a beverage box having a handle means on an upper surface thereof; said holder comprising:

a main portion, a support member having means for mounting said support member to a fixed supporting surface, and a bracket extending from said support member with interengaging means that releasably engage second engaging means provided on said main portion;

a generally elongated member having sharp ends secured to said main portion; and said generally elongated member having means for engaging a handle means of a beverage box and for retaining a beverage box handle means on said elongated member by executing a 90° relative rotation between said main portion and a beverage box.

2. A holder according to claim 1 wherein the main portion and the elongated member are unitary.

3. A holder according to claim 1 wherein the mounting means comprises screws.

4. A holder according to claim 1 wherein said main portion and said elongated member are made of plastic.

5. A holder according to claim 1 wherein the generally elongated member is rotatable with respect to said main portion.

6. A holder according to claim 1, wherein said second engaging means comprises at least one slot extending through said main portion, and said bracket has a longitudinally extending member that is received within said at least one slot.

7. A holder according to claim 1 wherein the support member is a L-shaped member having a leg portion constituting said bracket extending outwardly from a fixed supporting surface.

8. A holder according to claim 7, wherein said second engaging means includes at least one slot extending at least partly through said main portion for receiving said leg portion of said support member.

9. A holder according to claim 7 wherein said bracket has a trapezoidal cross section.

10. A holder according to claim 9, wherein said second engaging means includes at least one slot having a trapezoidal cross section for receiving said bracket.

* * * * *